US010588818B2

(12) United States Patent
Krueger et al.

(10) Patent No.: US 10,588,818 B2
(45) Date of Patent: Mar. 17, 2020

(54) VIBRATORY SYSTEM FOR MASSAGE AND AUDIO GENERATION IN AN ARTICULATING BED

(71) Applicant: Ergomotion, Inc., Goleta, CA (US)

(72) Inventors: Joey Krueger, Santa Barbara, CA (US); Joseph Ermalovich, Santa Barbara, CA (US)

(73) Assignee: Ergomotion, Inc., Goleta, CA (US)

( * ) Notice: Subject to any disclaimer, the term of this patent is extended or adjusted under 35 U.S.C. 154(b) by 0 days.

(21) Appl. No.: 16/208,961

(22) Filed: Dec. 4, 2018

(65) Prior Publication Data

US 2019/0105224 A1 Apr. 11, 2019

Related U.S. Application Data

(63) Continuation of application No. 14/567,255, filed on Dec. 11, 2014, now Pat. No. 10,172,761.

(60) Provisional application No. 61/914,503, filed on Dec. 11, 2013.

(51) Int. Cl.

| | |
|---|---|
| ***A61G 7/015*** | (2006.01) |
| ***A61H 23/00*** | (2006.01) |
| ***A61H 23/02*** | (2006.01) |

(52) U.S. Cl.
CPC ..... *A61H 23/00* (2013.01); *A61H 23/0236* (2013.01); *A61G 7/015* (2013.01); *A61H 2201/0142* (2013.01)

(58) Field of Classification Search
CPC ..... A61G 7/15; A61G 7/015
USPC ..... 5/613–618
See application file for complete search history.

(56) References Cited

U.S. PATENT DOCUMENTS 6,209,157 B1 * 4/2001 Hensley ..... A47C 20/041 5/613
6,544,165 B1 * 4/2003 McNew ..... A61M 21/0094 600/27

* cited by examiner

*Primary Examiner* — Fredrick C Conley
(74) *Attorney, Agent, or Firm* — Felix L. Fischer

(57) ABSTRACT

An articulating bed incorporating a frame employs a support member for a mattress secured to a frame for articulating motion. An upper body portion of the support member is rotatable through a range of motion from an aligned position with the frame to a fully elevated position angularly supporting the upper body portion in a raised position. A massage exciter is affixed to a bottom surface of the support member and is operative to sonically engage the flexible support.

8 Claims, 16 Drawing Sheets

VIBRATORY SYSTEM FOR MASSAGE AND AUDIO GENERATION IN AN ARTICULATING BED

REFERENCE TO RELATED APPLICATIONS

This application is a continuation of application Ser. No. 14/567,255 filed on Dec. 11, 2014 entitled VIBRATORY SYSTEM FOR MASSAGE AND AUDIO GENERATION IN AN ARTICULATING BED, which claims priority of U.S. provisional application Ser. No. 61/914,503 filed on Dec. 11, 2013 entitled VIBRATORY SYSTEM FOR MASSAGE AND AUDIO GENERATION IN AN ARTICULATING BED WITH FLEXIBLE MATTRESS SUPPORT, and having a common assignee, the disclosure of which is incorporated herein by reference.

BACKGROUND

Field

This invention relates generally to the field of adjustable beds and more particularly to a vibratory system for massage and audio generation in a structure for an articulating bed with a mattress support.

Description of the Related Art

Articulating beds have long been used in hospital and healthcare facilities to allow positioning of a patient in a reclining position, sitting position, elevated leg position or combinations of these positions. General usage of articulating beds has been rapidly expanding due to the comfort and convenience available from adjusting the bed to desired positions for reading, general relaxation or sleeping. Massage units have been added to articulating beds for creating vibratory stimulation in or through the mattress to provide a massaging action to the occupant of the bed.

Typically massage units are installed in cutouts in mattress support elements on the articulating bed to operate on or against the mattress itself. Transmission of the vibratory energy to the mattress may be significantly damped by the material of the mattress. Additionally, the cutout and massage inducer support structure adds complexity to the bed structure.

It is therefore desirable to provide an articulating bed having a vibratory massage system which overcomes the shortcomings of the prior art.

SUMMARY

The embodiments disclosed herein provide an articulating bed incorporating a frame having side frame members and a rigid cross frame member extending between the side frame members. A rigid support member in an articulating structure having a range of motion from an aligned position with the side frame members to a fully elevated position angularly supporting an upper body portion in a raised position. At least one massage exciter is affixed to a bottom surface of the rigid support member. The exciter is operative to sonically engage the rigid support member.

BRIEF DESCRIPTION OF THE DRAWINGS

These and other features and advantages of the present invention will be better understood by reference to the following detailed description of exemplary embodiments when considered in connection with the accompanying drawings wherein.

DETAILED DESCRIPTION

Figure 1A:
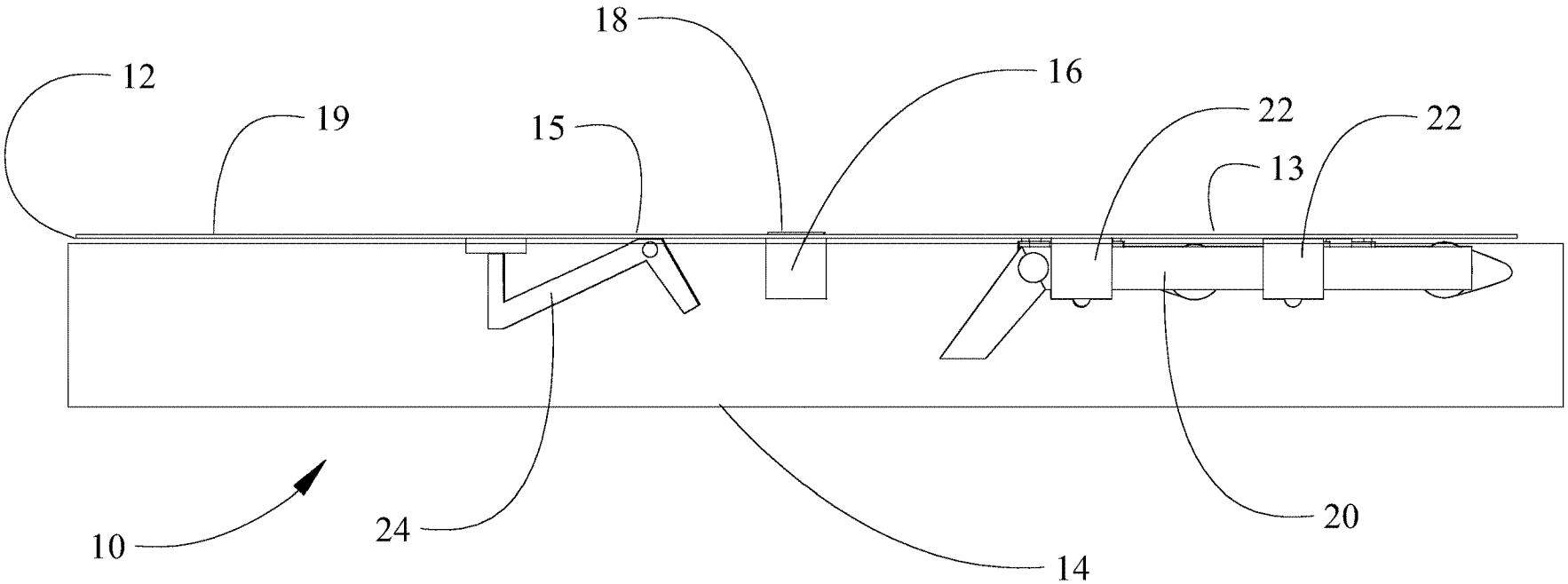
FIG. 1A is a side view of an adjustable bed system having a flexible support with side supports removed for clarity and the flexible support member flat.

Embodiments shown in the drawings and described herein provide an articulating bed which eliminates the rigid individual support platforms and uses a continuous flexible support member for the mattress with direct inducement of vibration into the flexible support member for massage or audio generation. Referring to the drawings, FIG. 1A show an exemplary adjustable bed system 10 which incorporates a flexible support or member 12 to support a mattress. The flexible support in an exemplary embodiment is a ⅛ inch sheet of fiber reinforced plastic (FRP) which is fire resistant (FR). Side frame members 14 support a cross member 16 to which the flexible member 12 is secured using plates or discs 18 (best seen in FIG. 3) with bolts extending through the FRP. Rotatable upper body support arms 20 support an upper body portion 13 of the flexible support member 12 toward the upper end of the bed. The flexible support member 12 is lubriciously supported on the support arms 20 to reposition itself during motion of the support arms. In one example embodiment, shuttles 22 which are supported on the support arms 20 are attached to the flexible support member 12. A leg portion adjustment member 24 is positioned to contact the flexible support member at approximately the knee position 25 of a user between a thigh portion 15 and lower leg portion 19 of the flexible support member 12. The side frames may include insets which receive the edges of the flexible support member 12 in the flat condition.

Figure 1B:
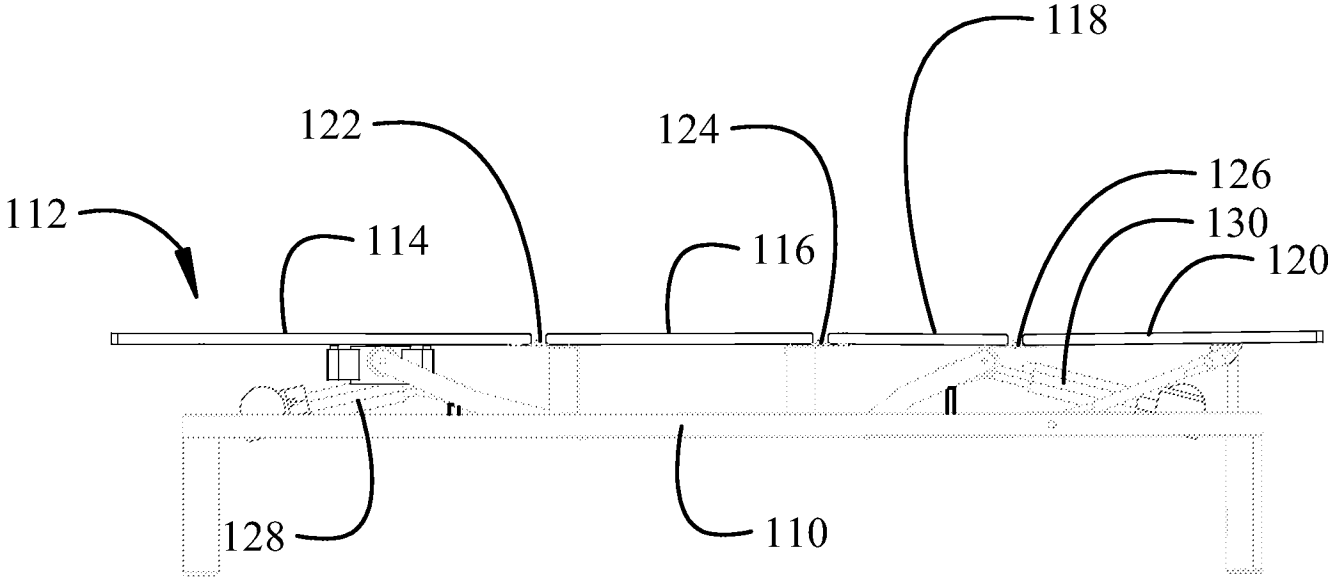
FIG. 1B is a side view of an adjustable bed system having rigid support elements in an articulating structure and the articulating structure flat.

Conventional adjustable bed structures such as shown in FIG. 1B having rigid support elements in the articulating structure are equally applicable for incorporation of the embodiments for massage exciters as disclosed herein. The articulating bed incorporates a frame 110 upon which an articulating support system 112 is mounted. The articulating support system 112 incorporates multiple rigid support sections for the body; an upper body section 114, a seat section 116, a thigh section 118 and a lower leg section 120. In a fully unarticulated position, as shown in FIG. 1B the upper body section 114, seat section 116, thigh section 118 and lower leg section 120 are aligned in a planar relationship. In a fully articulated position the upper body section 114 articulated by an actuator assembly 128 rotates about an articulation axis extending through hinges 122 connecting the upper body section 114 to the seat section 116. The thigh section 118 articulated by a second actuator assembly 130 rotates about a second articulation axis extending through hinges 124 connecting the thigh section 116 to the seat section 116 while Lower leg section 120 rotates about a third articulation axis extending through hinges 126 connecting the lower leg section 120 to the thigh section 118.

Figure 2A:
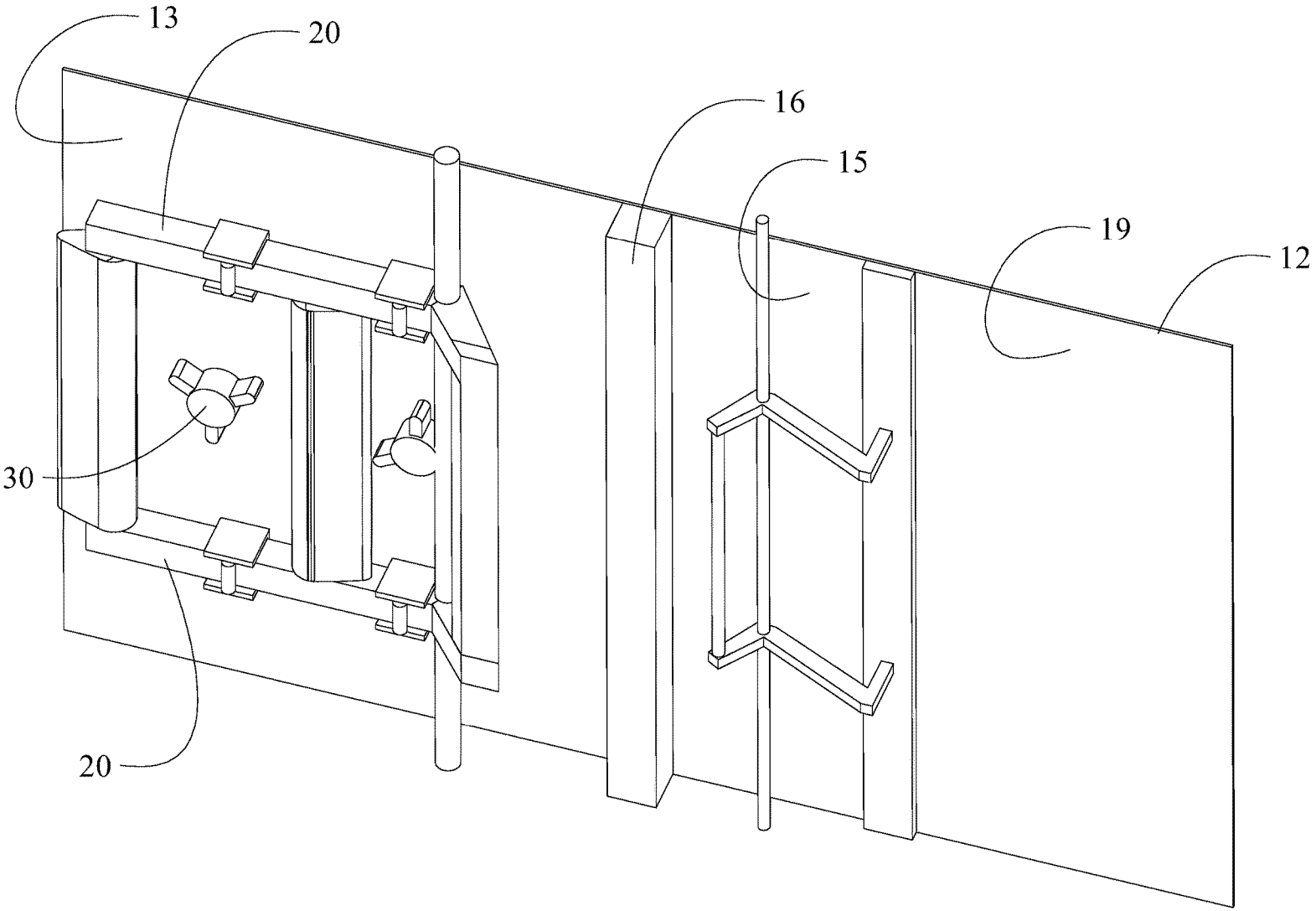
FIG. 2A is a pictorial view of an exemplary embodiment employing the structure of FIG. 1A from under the bed with side supports removed for clarity and the flexible support member flat.
Figure 2B:
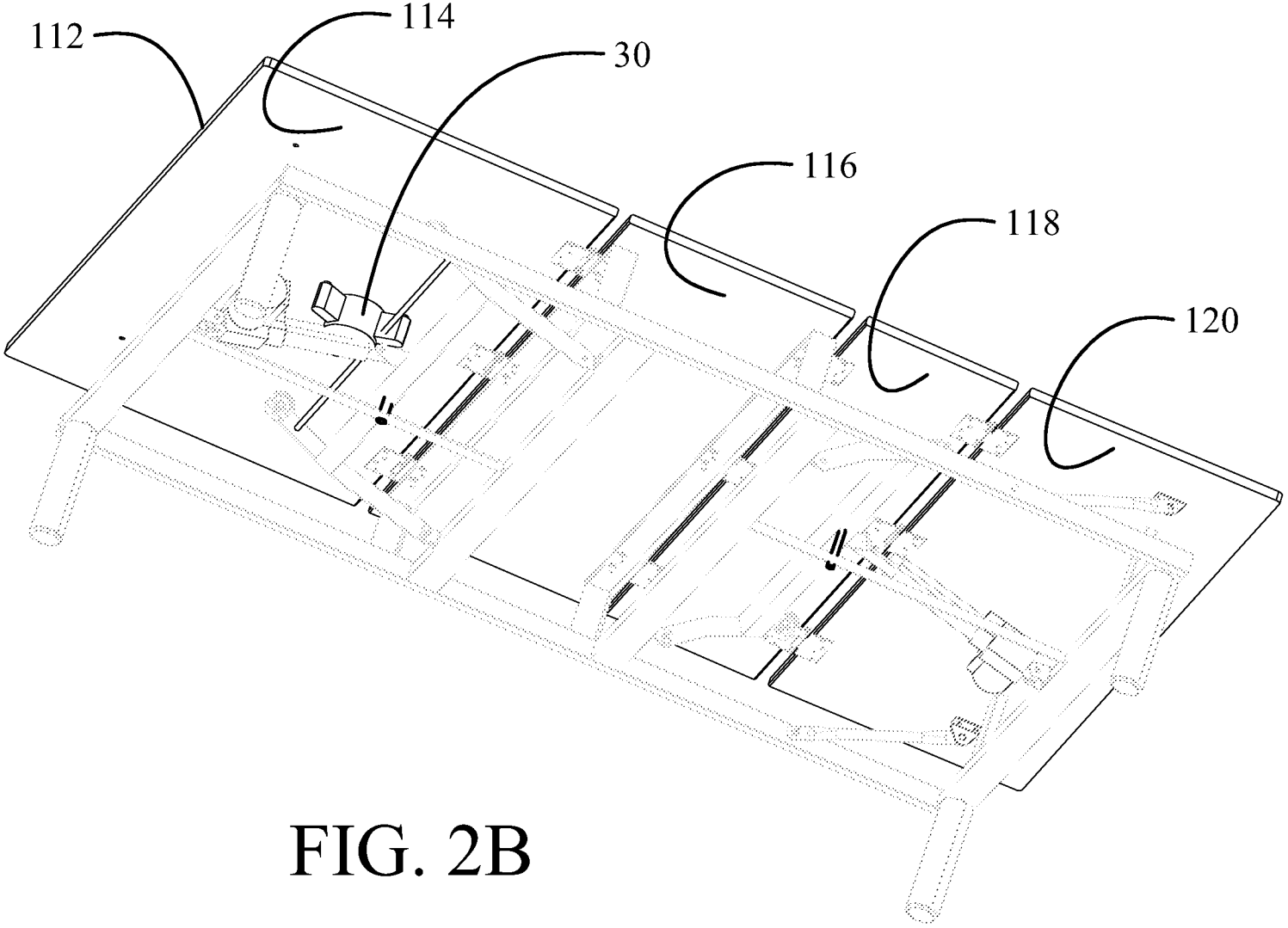
FIG. 2B is a pictorial view of an exemplary embodiment employing the structure of FIG. 1B from under the bed and the articulating structure rigid support members flat.

As seen in FIG. 2A, a massage exciter 30 is attached to the flexible support member 12 in an upper body portion 13 as will be described in greater detail subsequently. Similarly as seen in FIG. 2B, a massage exciter 30 may be attached to the upper body section 114 of the conventional articulating support system. For the embodiments described subsequently, application of massage exciters to the upper body portion, thigh portion and lower leg portion of the flexible support member 12 are equally applicable to an upper body section, thigh section and lower leg section in a rigid articulating system 112.

Figure 3A:
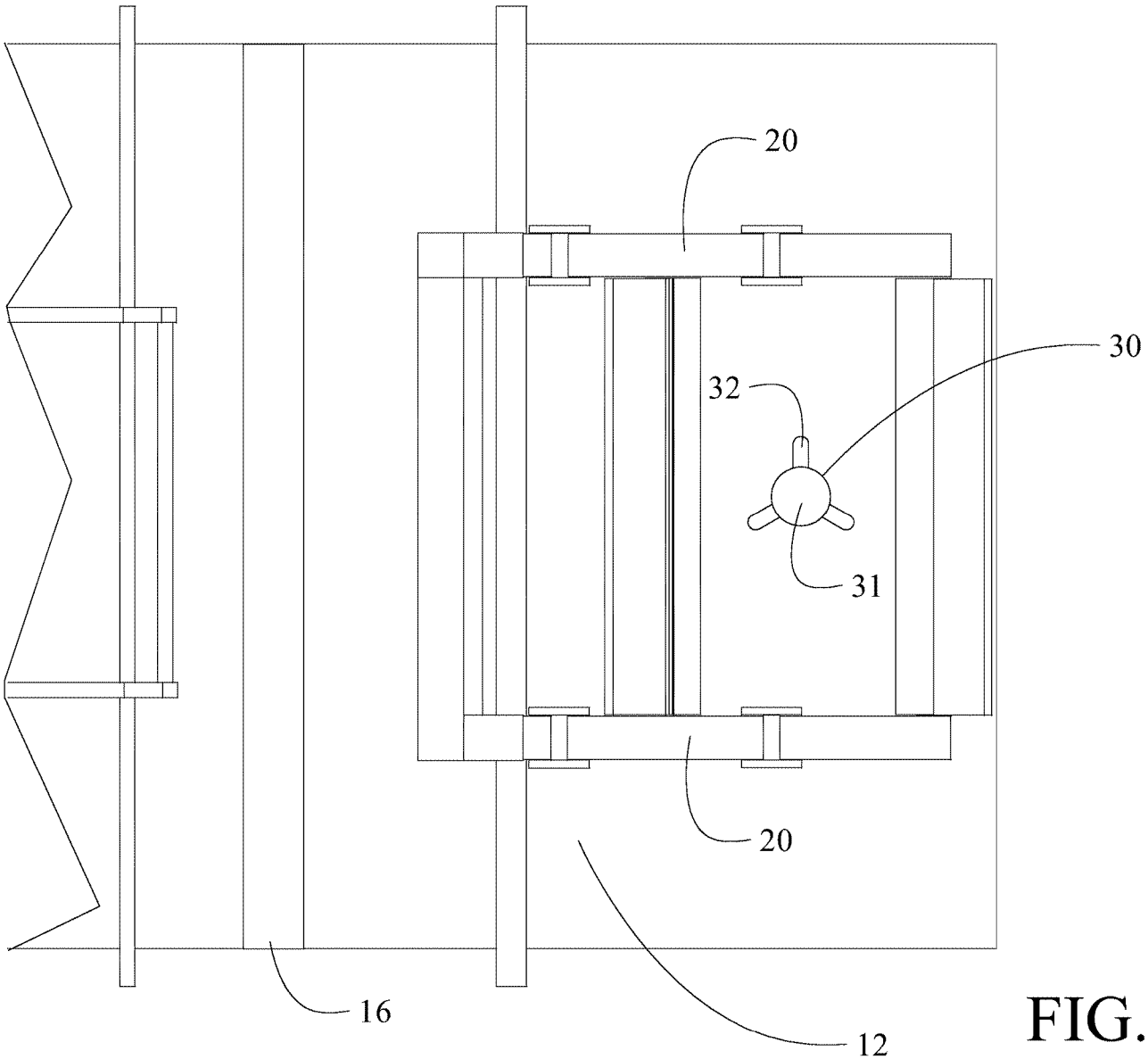
FIG. 3A is a partial bottom view of the bed showing attachment of a massage exciter to the flexible support member in the upper body portion.

As best see in FIG. 3A, at least one massage exciter 30 is affixed to the flexible support member 12 between the support arms 20 on the upper body portion 13 of the flexible support member. The massage exciter 30 interfaces with the flexible member 12 which responds to the exciter in a manner similar to a speaker cone. In exemplary embodiments the massage exciter 30 incorporates an exciter element 31 attached with extension arms 32 to the flexible member 12. Adhesive pads or other alternative fixing mechanism on the extension arms may be employed to secure the extension arms to the flexible member. The exciter element 31 sonically engages the flexible member 12. The sonic engagement of the exciter element 31 allows the massage exciter to directly inducing vibration in the flexible support member 12 to provide the desired massage. An example massage exciter for the described embodiments is the DAEX25 Sound Exciter by Dayton Audio, 705 Pleasant Valley Dr., Springboro, Ohio 45066. A second example massage exciter for the described embodiments is the AMS01BL base shaker by ADX 17835 Newhope St, Studio A, Fountain Valley, Calif. 92708.

Figure 3B:
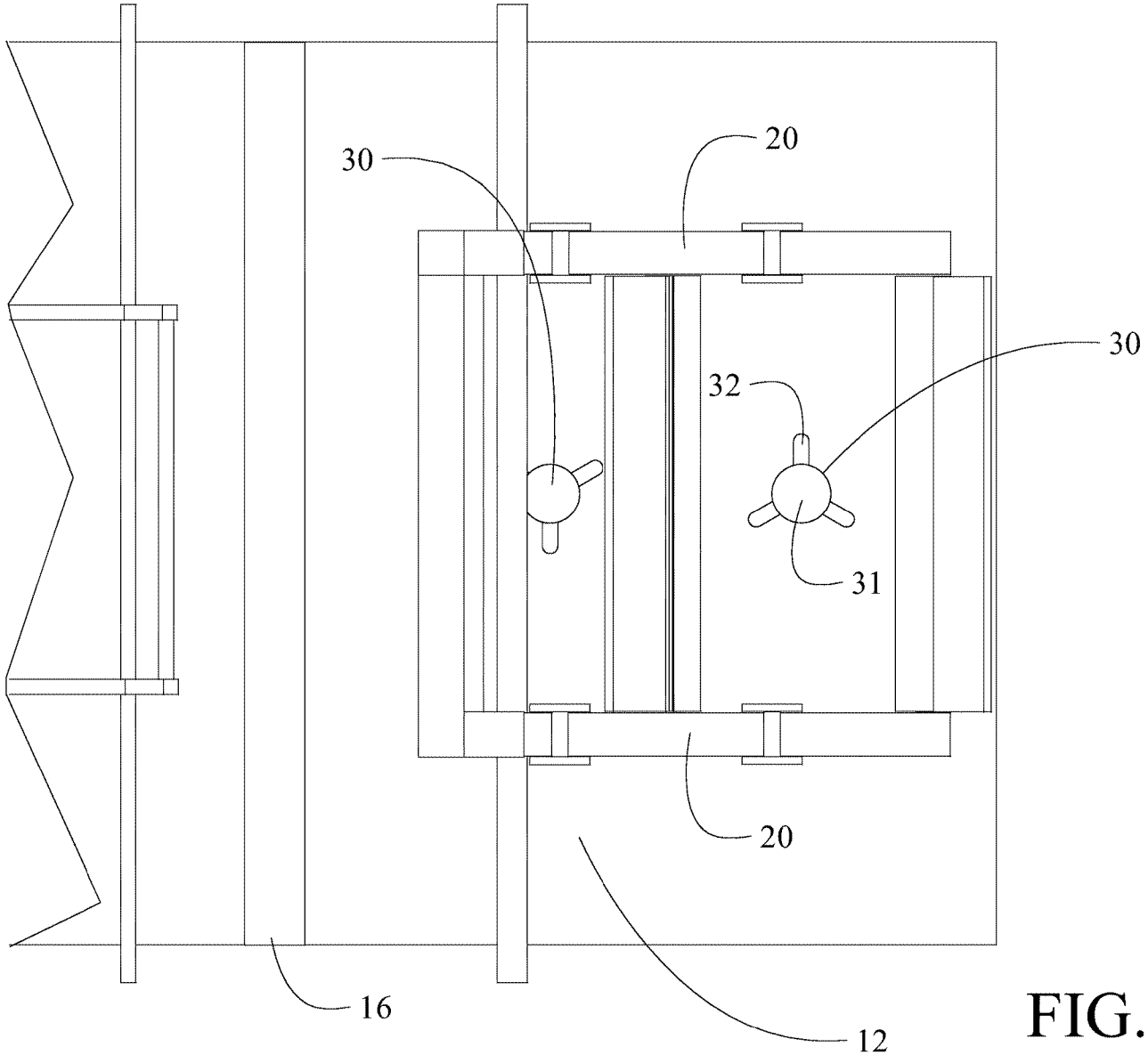
FIG. 3B is a partial bottom view of the bed showing attachment of two longitudinally aligned massage exciters to the flexible support member in the upper back and lower lumbar portions of the upper body portion.
Figure 3C:
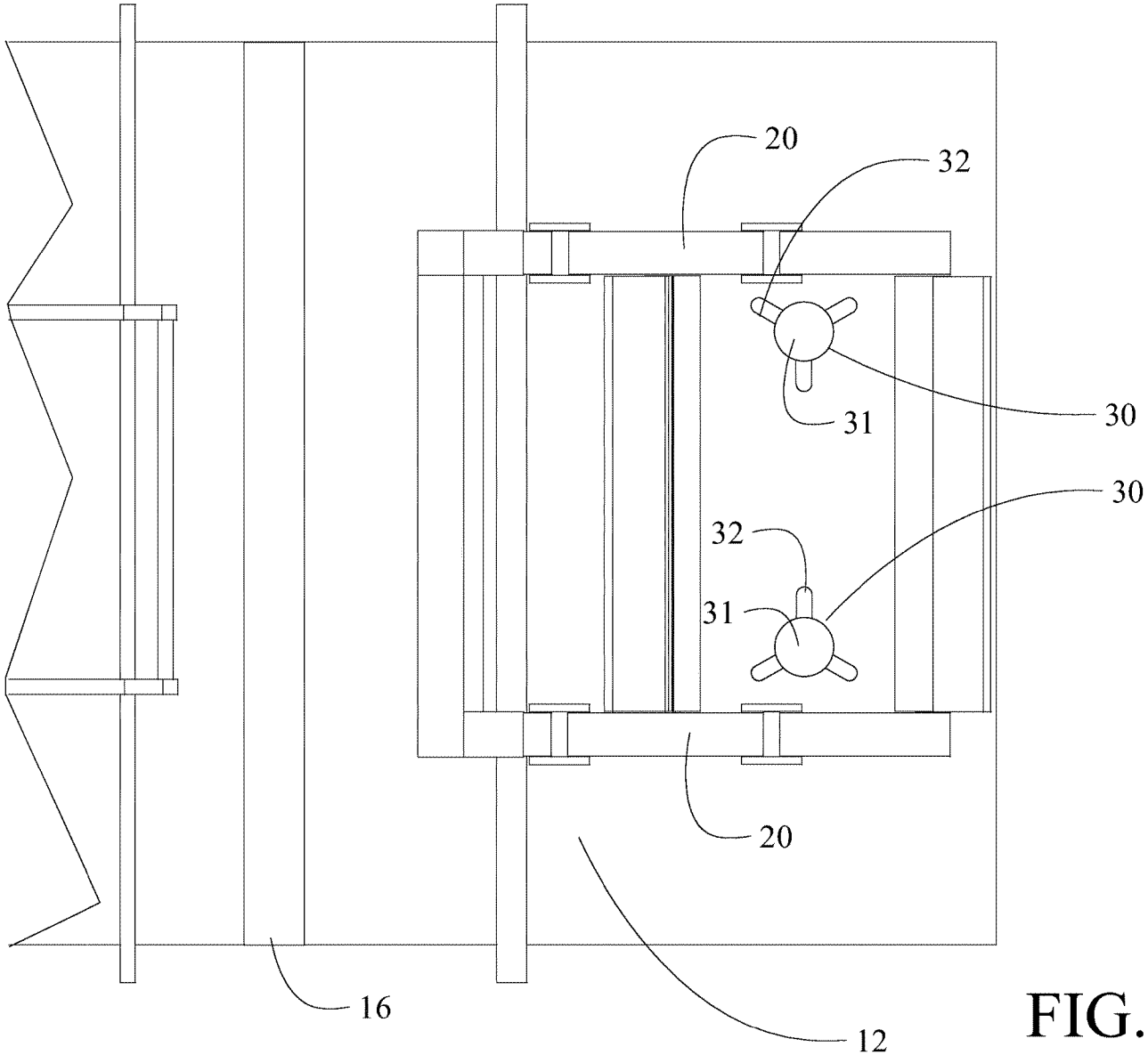
FIG. 3C is a partial bottom view of the bed showing attachment of two laterally aligned massage exciters to the flexible support member in the upper body portion.
Figure 3D:
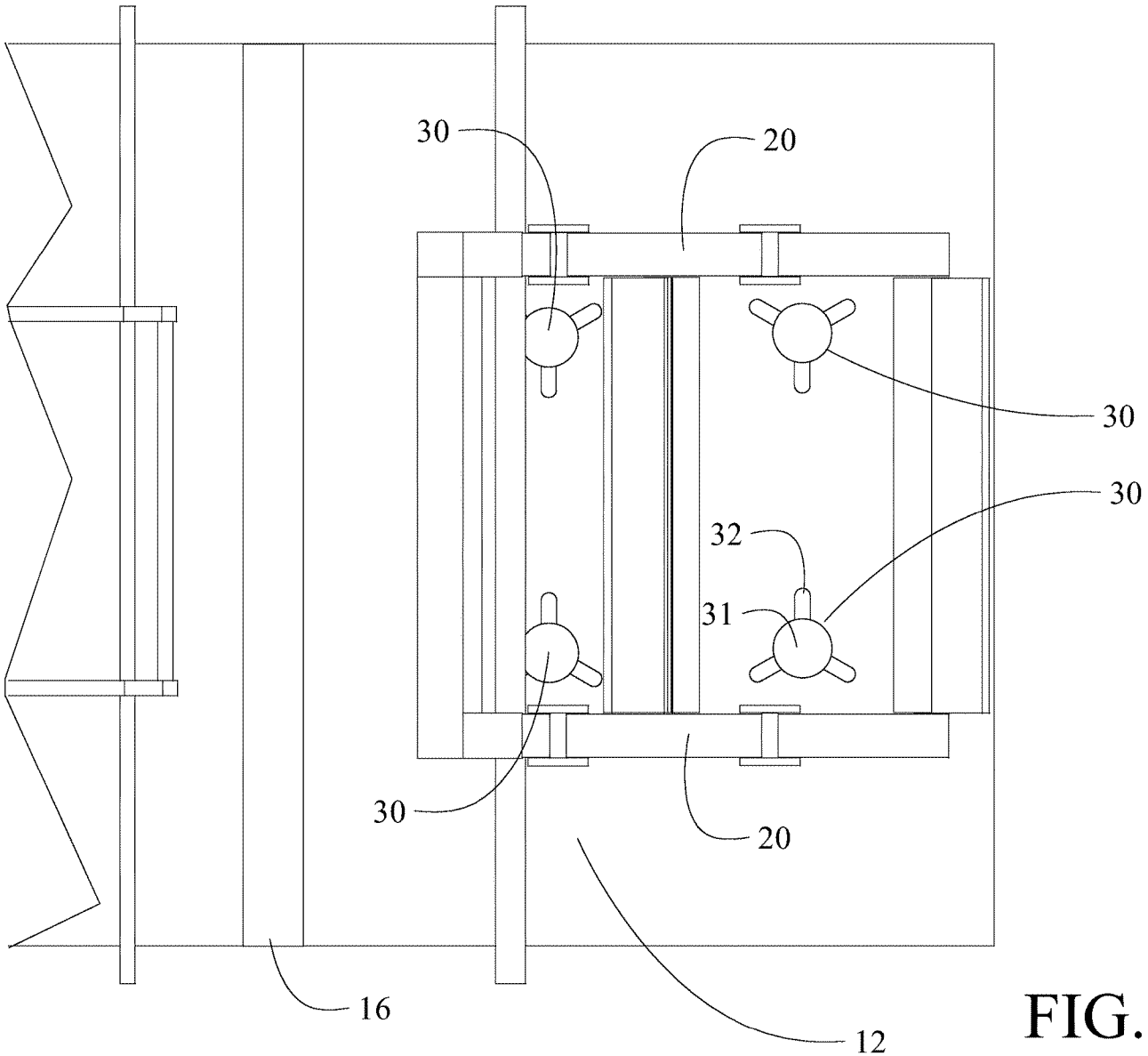
FIG. 3D is a partial bottom view of the bed showing attachment of both longitudinally and laterally aligned massage exciters to the flexible support member in the upper body portion.

The massage exciter 30 may be placed in position for targeted massage of the upper back and shoulders or the lower back and lumbar region. Multiple massage exciters may be positioned in an aligned longitudinal pattern as shown in FIG. 3B to provide massage of both the upper and lower back, together or individually. Additionally, multiple exciters may be positioned in an aligned lateral pattern as shown in FIG. 3C to provide enhanced massage to the upper or lower back, or in single articulating double beds to provide separate massage units for two occupants in the bed. Laterally aligned and longitudinally aligned massage exciters may be mounted to the flexible member 12 as shown in FIG. 3D.

Figure 4A:
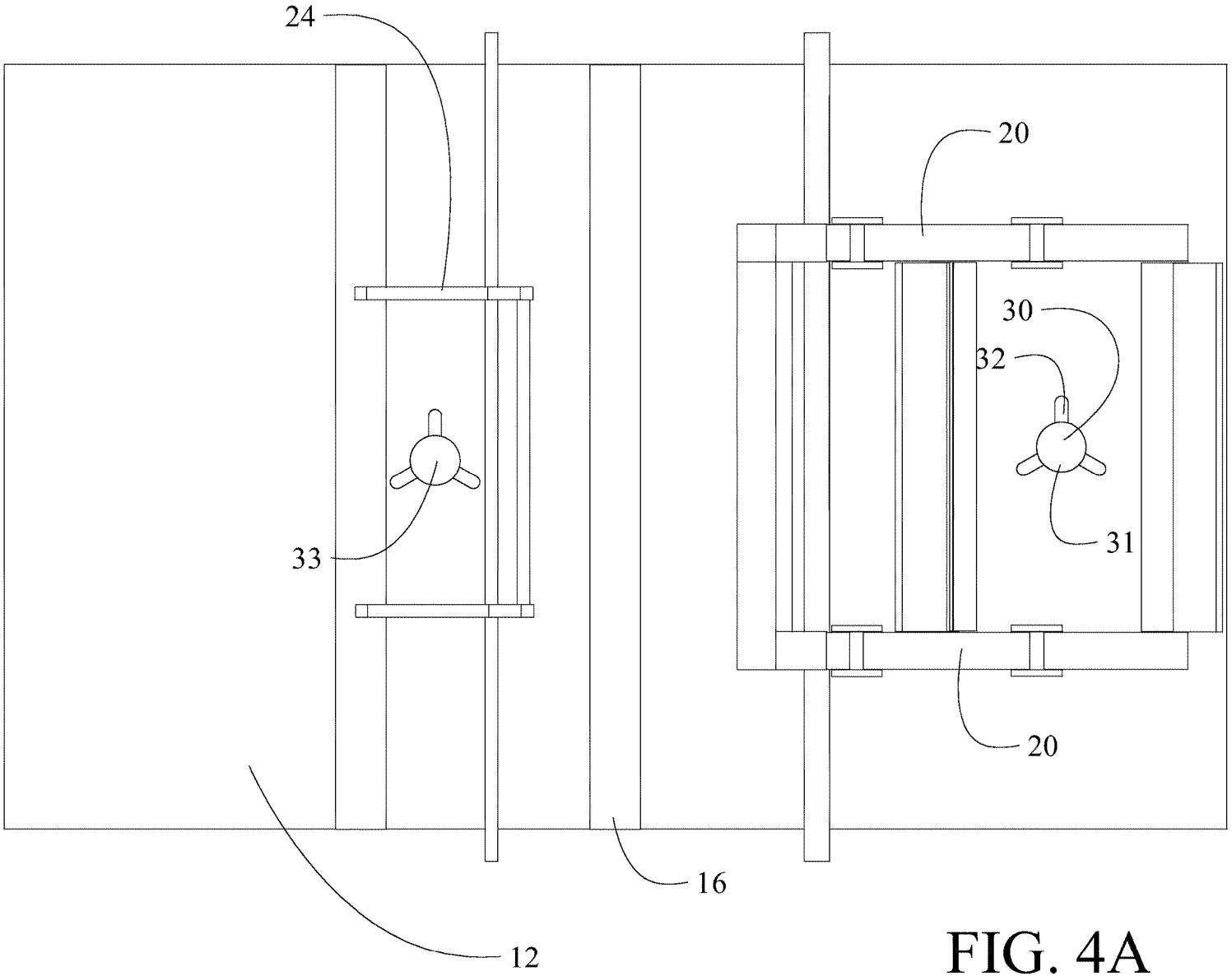
FIG. 4A is a bottom view of the bed showing attachment of a massage exciter to the flexible support member in the upper body portion and attachment of a massage exciter to the flexible support member in the thigh portion.
Figure 4B:
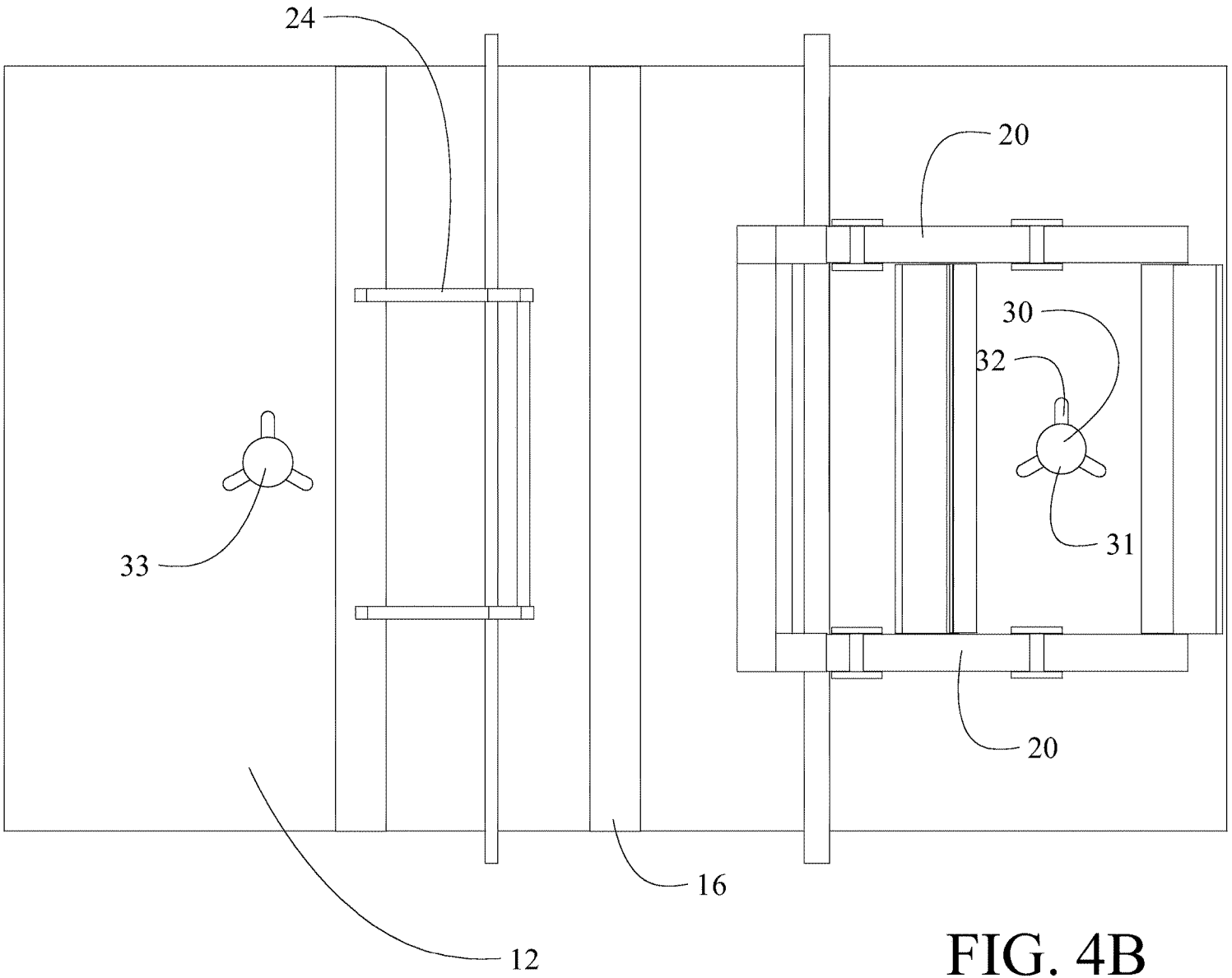
FIG. 4B is a partial bottom view of the bed showing attachment of a massage exciter to the flexible support member in the upper body portion and attachment of a massage exciter to the flexible support member in the lower leg portion.
Figure 4C:
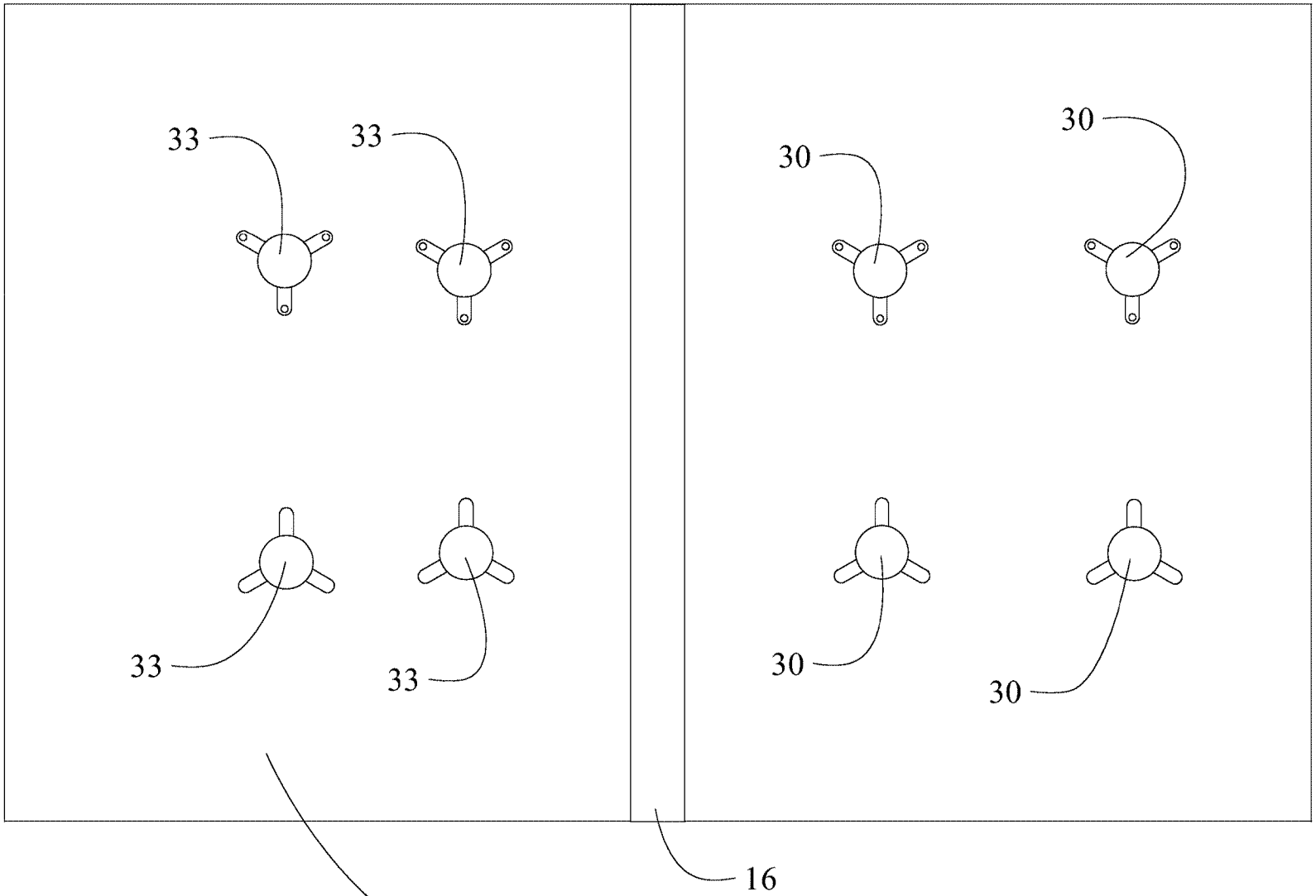
FIG. 4C is a bottom view of the flexible support member showing attachment of laterally aligned massage exciters in the upper back, lumbar, thigh and lower leg portions.

Massage exciters 33 may also be positioned on the thigh portion 14 or lower leg portion 10 of the flexible support member for massaging the legs as shown in FIGS. 4A and 4B. An example pattern of massage exciters mounted to the flexible member 12 for upper back, lumbar, thigh and lower leg for two occupants in a double bed arrangement is shown in FIG. 4C.

Figure 5:
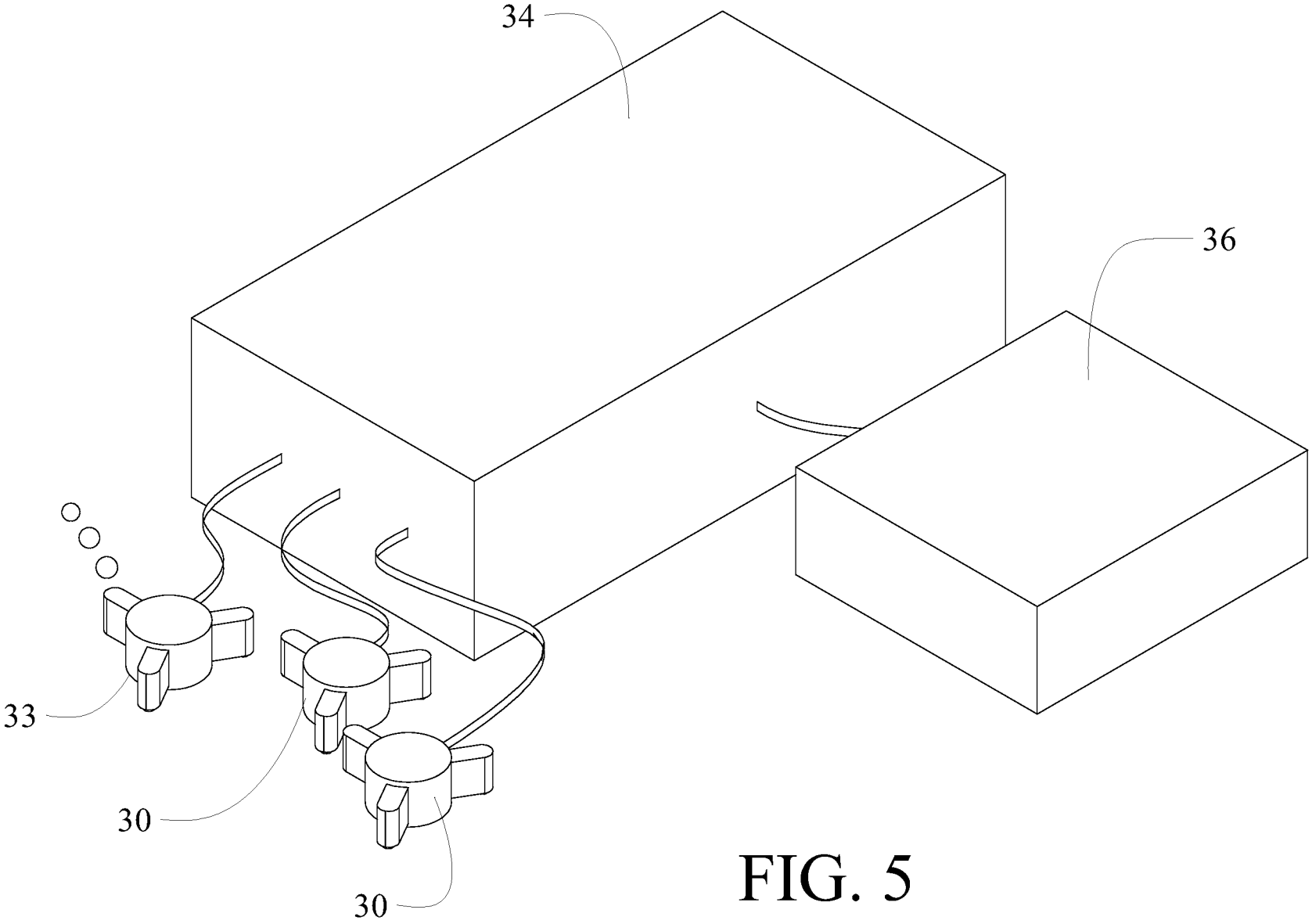
FIG. 5 is a block representation of multiple massage exciters connected to a control unit with an signal generator.

A control unit 34 as shown in FIG. 5 connects to the massage exciters to provide an input signal. Separate control of multiple message exciters by the control unit allows separate activation of the various massage locations desired by the occupant. A signal generator 36 provides the input signal for the message exciters and may be selectable for various frequencies and amplitudes to sonically engage the flexible member to create the desired massage. The signal generator 36 may be or may include an audio source generating music in addition to or as the massage excitation.

Figure 6:
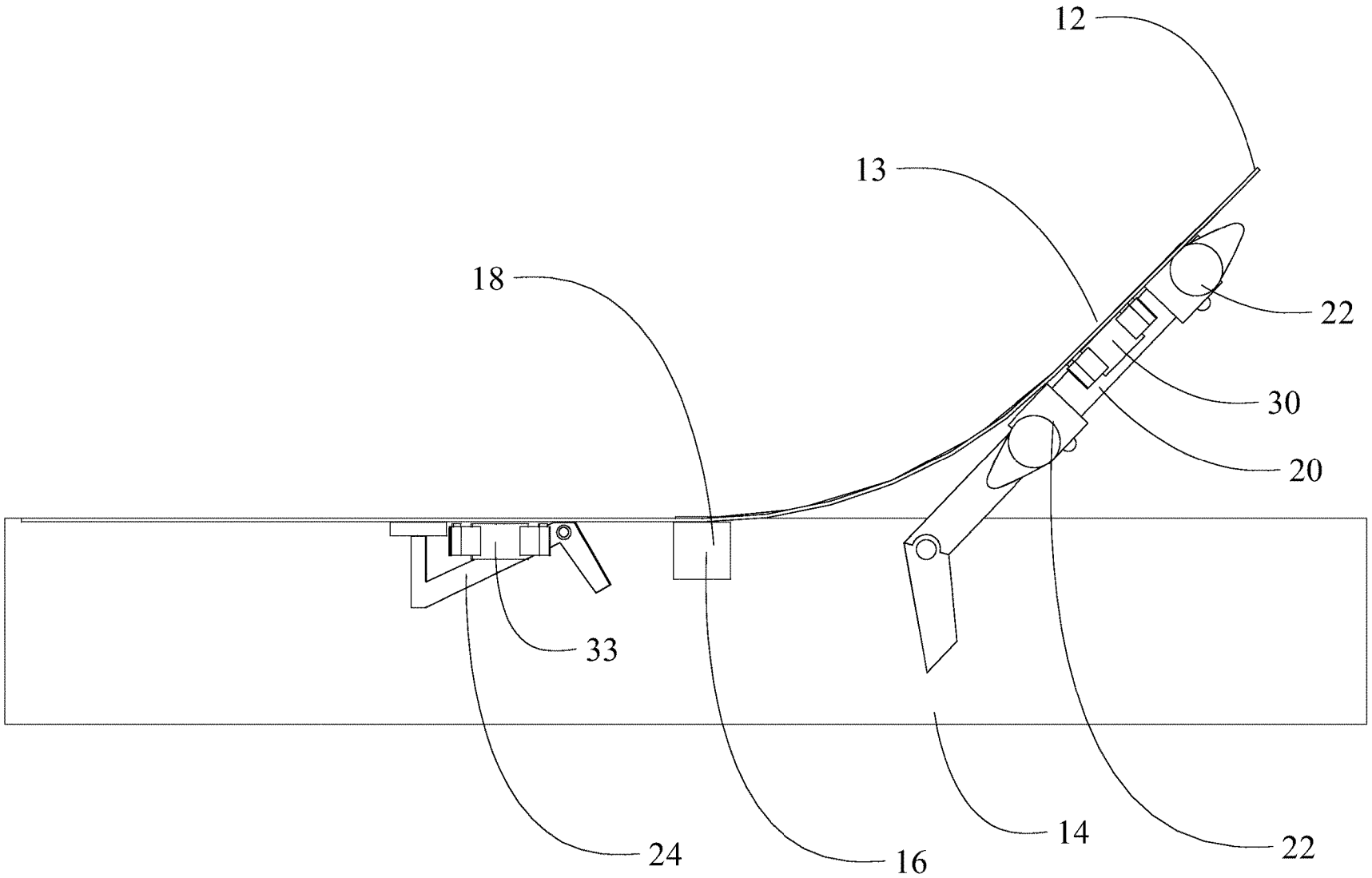
FIG. 6 is side view of the adjustable bed system with the upper body portion raised and the left side frame member and upper body support arm removed for clarity.
Figure 7:
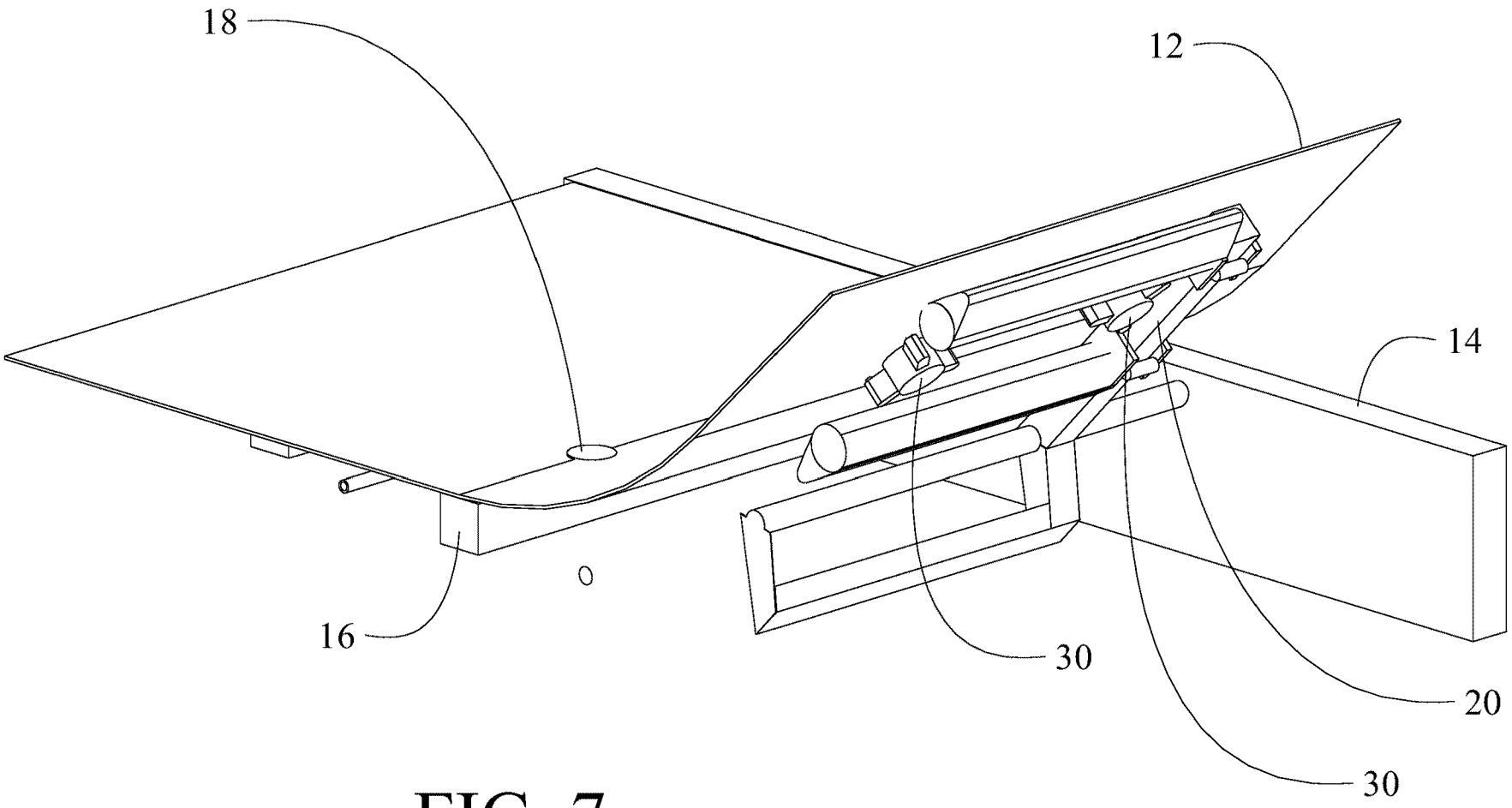
FIG. 7 is a pictorial view of the bed with the head portion raised with the left side frame member and upper body support arm removed for clarity.

As seen in FIGS. 6 and 7, the upper body portion 13 of the flexible support member 12 may be raised by rotating the upper body support arms 20 about axles 26 extending to and supported by the side frame members 14. Actuation levers 21 on the support arms 20 may be attached to an actuator 23 for rotation. The shuttles 22 reciprocate along the support arms 20 to maintain the flexible support member 12 in contact with the support arms at desired points for proper shaping of the mattress. Direct connection of the massage exciters 30 to the flexible support member 12 allows massage in any articulated position of the upper body portion of the bed. The small profile and light weight of the massage exciters 30 avoids any additional structural requirements in the articulation actuators or the structural support elements of the bed.

Figure 8:
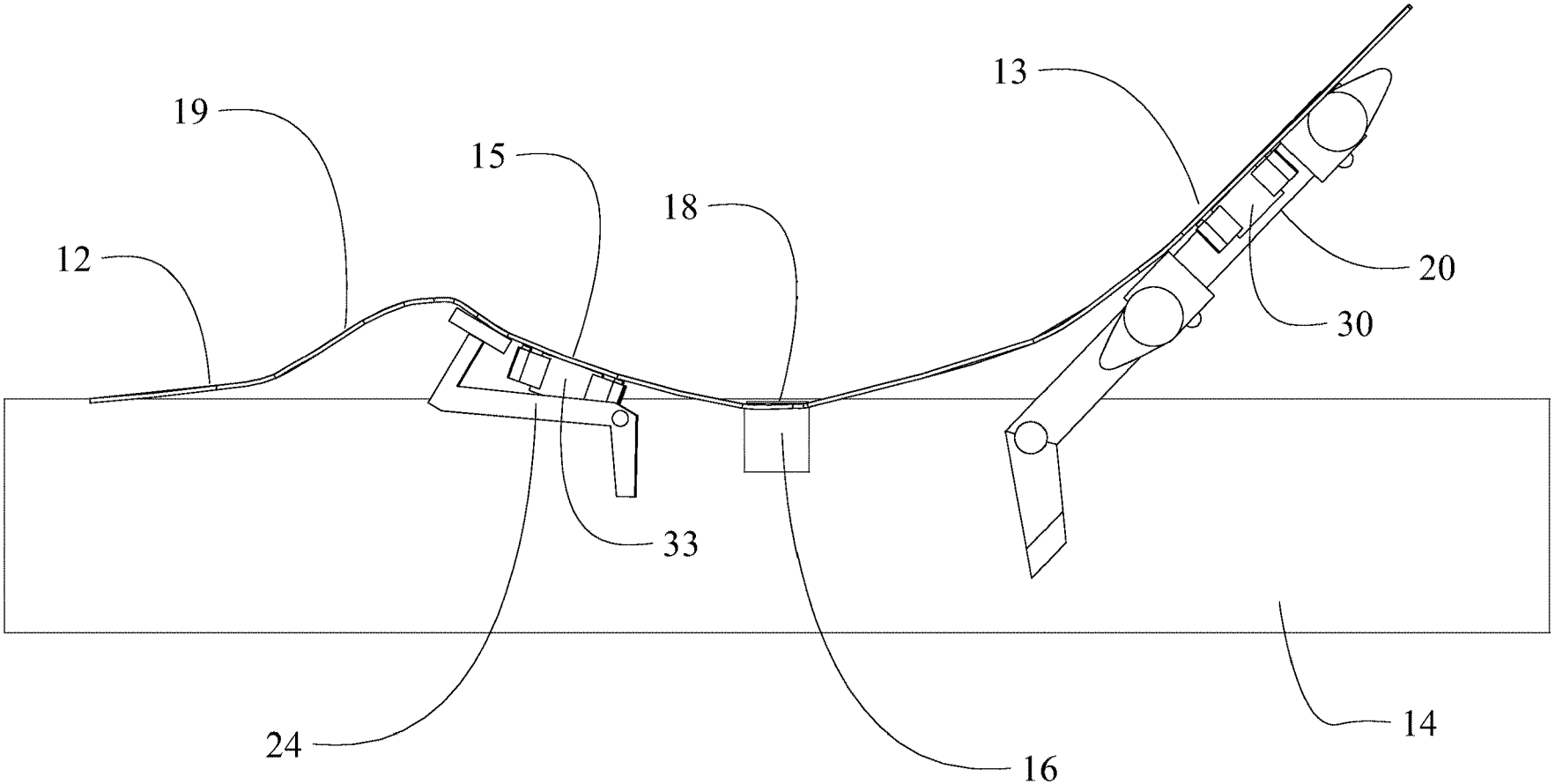
FIG. 8 is a side view of the bed with the head portion and leg portion raised; and, FIG. 9 is a pictorial under view of the bed with the head and leg portions raised
Figure 9:
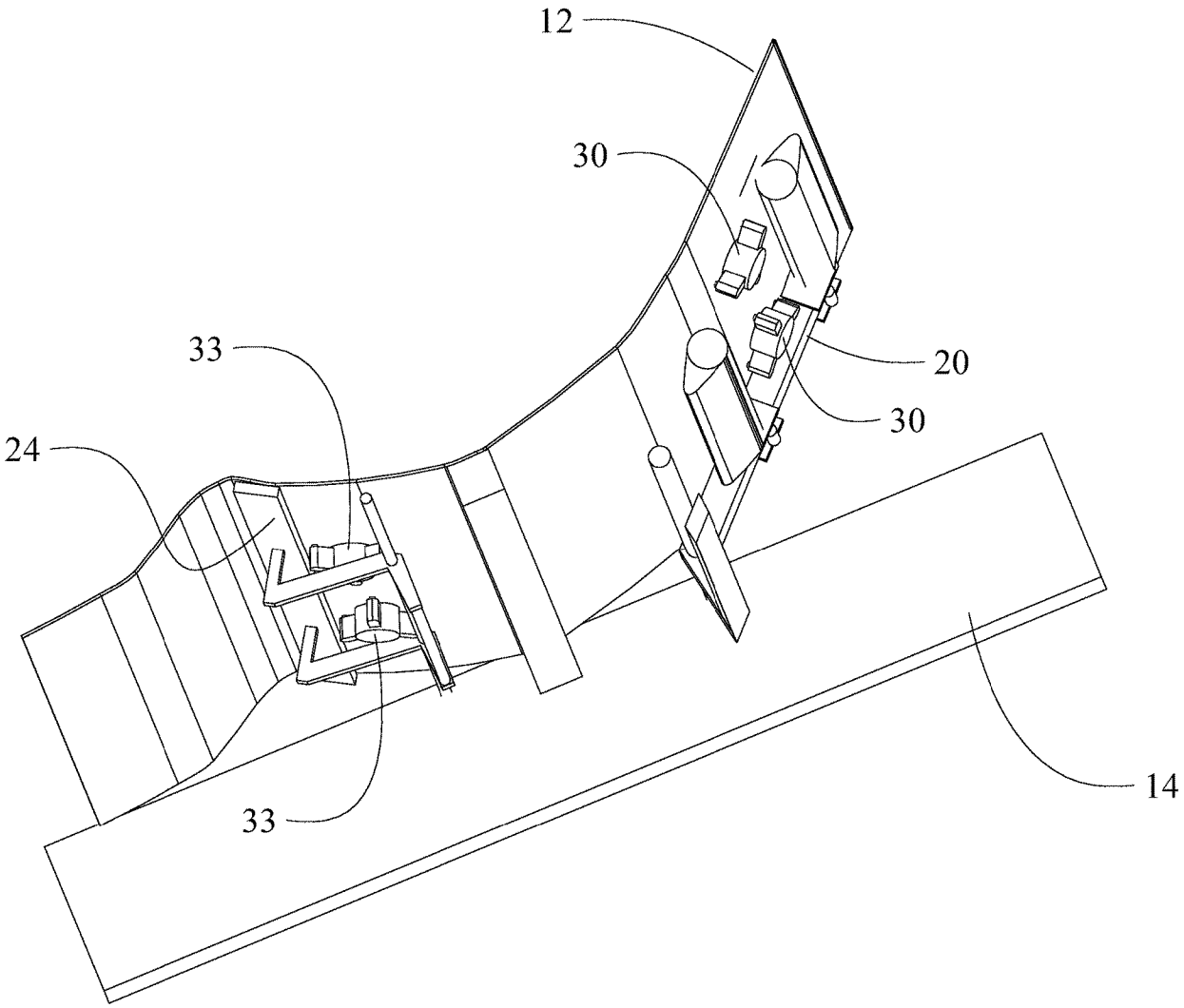

As shown in FIGS. 8 and 9, the leg portion adjustment member 24 may be rotated about axle 28 which raises the flexible support member 12 at the knee position of the user. The flexible support member 12 flexes over the rotated leg portion adjustment member seeking a neutral position with the thigh portion 15 and lower leg portion 19 draped over the leg portion adjustment member 24. The flexible support member 12 establishes a smooth curvature in both the upper body portion 13 and thigh and lower leg portions 15, 19 of the bed based on natural flexing with the center of the member secured at the rigid cross member 16. As with the articulation of the upper body portion 13, direct connection of the massage exciters 33 to the flexible support member 12 in the thigh portion 15 and/or lower leg portion 19 allows massage in any articulated position of the thigh and/or lower leg portions of the bed. The small profile and light weight of the massage exciters 33 avoids any additional structural requirements in the articulation actuators or the structural support elements of the bed.

Having now described various embodiments of the invention in detail as required by the patent statutes, those skilled in the art will recognize modifications and substitutions to the specific embodiments disclosed herein. Such modifications are within the scope and intent of the present invention as defined in the following claims.

What is claimed is:

1. A massage system for articulating beds comprising:

a support member adapted to receive a mattress and configured for repositioning during articulation; and, at least one massage exciter having an exciter element attached with extension arms directly affixed to a bottom surface of the support member, said massage exciter operative to sonically engage the support member directly inducing vibration in said support member, wherein the support member is a rigid support section in an articulating structure.

2. The massage system for articulating beds as defined in claim 1 wherein the rigid support section is an upper body section pivotally secured to a seat section; and the upper body section is articulated by an actuator assembly to rotate about an articulation axis extending through hinges connecting the upper body section to the seat section.

3. The massage system for articulating beds as defined in claim 2 further comprising:

a second actuator assembly engaging a thigh section;

said thigh section articulated by the second actuator assembly to rotate about a second articulation axis extending through second hinges connecting the thigh section to the seat section while a lower leg section rotates about a third articulation axis extending through third hinges connecting the lower leg section to the thigh section.

4. The massage system for articulating beds as defined in claim 3 wherein the at least one massage exciter comprises a first massage exciter having an exciter element attached with extension arms directly affixed to the upper body section to sonically engage the upper body section and a second massage exciter having an exciter element attached with extension arms directly affixed to the thigh section of the articulating support structure to sonically engage the thigh section.

5. The massage system for articulating beds as defined in claim 1 further comprising a control system operative connected to the at least one massage exciter to provide a desired frequency and amplitude for sonic engagement of the rigid support section.

6. The massage system for articulating beds as defined in claim 5 wherein the at least one massage exciter comprises a plurality of massage exciters each having an exciter element attached with extension arms directly affixed to the rigid support sections of the articulating structure and said control system is operative to provide the desired frequency and amplitude to selected massage exciters to sonically engage each of the plurality of massage exciters with an associated rigid support section.

7. The articulating bed as defined in claim 1 further comprising a control system operative connected to the at least one massage exciter to provide a desired frequency and amplitude for sonic engagement of the rigid support member.

8. The articulating bed as defined in claim 7 wherein the at least one massage exciter comprises a plurality of massage exciters affixed to the rigid support member and said control system is operative to provide the desired frequency and amplitude to selected massage exciters.

* * * * *